US009255362B2

(12) United States Patent
Barry et al.

(10) Patent No.: US 9,255,362 B2
(45) Date of Patent: Feb. 9, 2016

(54) RAIL ANCHOR

(75) Inventors: David M. Barry, Greenwood, MN (US); Timothy John Austin, Rocky Ford, CO (US); Luigi Pisano, Calgary (CA)

(73) Assignee: Lewis Bolt & Nut Company, Wayzata, MN (US)

( * ) Notice: Subject to any disclaimer, the term of this patent is extended or adjusted under 35 U.S.C. 154(b) by 379 days.

(21) Appl. No.: 13/700,034

(22) PCT Filed: May 26, 2011

(86) PCT No.: PCT/US2011/038156

§ 371 (c)(1), (2), (4) Date: Apr. 2, 2013

(87) PCT Pub. No.: WO2011/150219

PCT Pub. Date: Dec. 1, 2011

(65) Prior Publication Data

US 2013/0206855 A1 Aug. 15, 2013

Related U.S. Application Data

(63) Continuation of application No. 13/025,898, filed on Feb. 11, 2011, now abandoned.

(60) Provisional application No. 61/348,528, filed on May 26, 2010.

(51) Int. Cl.
*E01B 13/02* (2006.01)

(52) U.S. Cl.
CPC ..... *E01B 13/02* (2013.01); *Y10T 29/49947* (2015.01)

(58) Field of Classification Search
CPC ..... E01B 13/02
USPC ..... 238/310, 315, 321, 327 R
See application file for complete search history.

(56) References Cited

U.S. PATENT DOCUMENTS

| | | | |
|---|---|---|---|
| 2,101,884 | A | 12/1937 | Warr |
| 2,163,299 | A | 6/1939 | Warr |
| 2,827,240 | A | 3/1958 | Steele et al. |
| 3,102,690 | A | 9/1963 | Fee |
| 3,837,572 | A | 9/1974 | Van Sant |
| 4,210,281 | A | 7/1980 | Fee |
| 4,572,432 | A | 2/1986 | Moehren |
| 4,715,534 | A | 12/1987 | Fee |
| 4,768,280 | A | 9/1988 | Palmer et al. |
| 4,922,743 | A | 5/1990 | Hillegass et al. |
| 7,147,169 | B2 | 12/2006 | Walsh |
| 2011/0290897 | A1 | 12/2011 | Barry |

OTHER PUBLICATIONS

International Search Report and Written Opinion in International Application No. PCT/US2011/038156, Dec. 21, 2011, 10 pages.

*Primary Examiner* — Zachary Kuhfuss
(74) *Attorney, Agent, or Firm* — Fish & Richardson P.C.

(57) ABSTRACT

Methods, systems, and apparatus, including an apparatus that is a rail anchor comprising a head, a tail, and a belly section. The belly section comprises a top surface, a bottom surface, and two side surfaces. Each side surface comprises a contact-bearing surface area. The head comprises a bend along a length of the head. The tail comprises a notch. Each contact-bearing surface area has a surface area of at least 3 square inches and is adapted to extend at least 1.5 inches downward from the top of a railroad track crosstie along a side of the railroad track crosstie.

12 Claims, 4 Drawing Sheets

RAIL ANCHOR

CROSS-REFERENCE TO RELATED APPLICATIONS

This application is a National Stage application under 35 U.S.C. 371 of International Application No. PCT/US2011/038156, having an International Filing Date of May 26, 2011, which claims priority to U.S. application Ser. No. 13/025,898, filed Feb. 11, 2011, which claims the benefit of U.S. Provisional Application Ser. No. 61/348,528, filed May 26, 2010. The disclosures of the prior applications are considered part of (and are incorporated by reference in) the disclosure of this application.

TECHNICAL FIELD

The subject matter of this application relates generally to an improved rail anchor, and in particular to a rail anchor having an increased bearing surface in the lower portion of a belly section of the rail anchor, and wherein in certain embodiments the rail anchor has a weight substantially equal to existing rail anchors despite the increased bearing surface.

BACKGROUND

In common railroad track structure, steel rails are supported on wood crossties. The rails rest on tie plates and are attached to the crossties using a variety of fasteners. The track structure also includes rail anchors, which are applied to the base of the rail. Rail anchors are applied either by hand with a sledge or driven on using a rail anchor application machine. When applied correctly, the rail anchor is secured to the rail base with one side positioned next to the side of the crosstie. The function of a rail anchor is to efficiently dissipate rail force into the track structure. This is done by having the rail anchor remaining stationary on the rail base, transferring rail forces to the side of cross ties subsequently into the ballast and providing longitudinal restraint for the rail, e.g., to prevent rail movement from, for example, train dynamics, track topography, and rail steel thermal forces, expansion during high temperatures and contraction during cold temperatures. Expanding rail can produce sun kinks or a wavy pattern in the rail, making the rail unsafe for train traffic. Conversely, contracting rail can produce pull-aparts or breaks in the rail, which also lead to an unsafe rail condition. In most applications, rail anchors are "boxed," meaning that four rail anchors are used per crosstie, with two rail anchors used per rail, each positioned on an opposite side of the crosstie. In tangent track, rail anchor patterns normally dictate that crossties be box-anchored at every other crosstie. It is also common for high-tonnage track to be box-anchored at every crosstie. Railroads also commonly box-anchor crossties at locations such as curves, rail crossings, when entering or leaving switches, and when entering or leaving bridges or tunnels. In general, when restricting rail movement is critical to maintaining the track structure, additional rail anchors are applied.

Wood crossties deteriorate over time; it is thus important to maintain maximum contact bearing area between the rail anchor and the crosstie that the rail anchor is contacting. Normal deterioration of a crosstie will occur initially at its edges and along the top of the crosstie, thereby leading to a potential loss of contact between the crosstie and the rail anchor. Any loss in contact area reduces the ability of the rail anchor to provide longitudinal restraint. In addition, the rail anchor most commonly used today can become embedded into the crosstie due to inferior bearing surface. Current rail anchor design used most commonly in the rail industry typically provides a rail anchor that has a contact-bearing surface area of about 2.9 square inches and weighs about 1.8 to 2.1 lbs., depending on the design.

SUMMARY

In general, one innovative aspect of the subject matter described in this specification includes an apparatus that is a rail anchor comprising a head, a tail, and a belly section. The belly section comprises a top surface, a bottom surface, and two side surfaces. Each side surface comprises a contact-bearing surface area. The head comprises a bend along a length of the head. The tail comprises a notch. Each contact-bearing surface area has a surface area of at least 3 square inches and is adapted to extend at least 1.5 inches downward from the top of a railroad track crosstie along a side of the railroad track crosstie.

These and other implementations can each optionally include one or more of the following features. The contact-bearing surface area can have a surface area of about 5.5 square inches. The head can also comprise a widened top surface along a length of the head. The tail can also comprise a widened top surface along a length of the tail. The widened top surface along the length of the head and the widened top surface along the length of the tail can be formed from a same substantially rectangular cross section of material that forms the belly section. The rectangular cross section of material can have a vertical dimension of about between 1.0 inches to 1.3 inches and a horizontal dimension of about between 0.5 inches to 0.75 inches. The rectangular cross section of material can have a vertical dimension of about 1.156 inches and a horizontal dimension of about 0.65 inches. The belly section can have a substantially rectangular cross section along a length of the belly section. Each of the side surfaces of the belly section can include a vertical dimension that exceeds a horizontal dimension of the top surface of the belly section. The contact-bearing surface area of each of the side surfaces can be adapted to contact the side of the railroad track crosstie. The rail anchor, by comprising the bend along the length of the head and the notch in the tail, can be adapted to engage opposite sides of a railroad track rail. The jaw opening in the bend along the length of the head can have a dimension of about 0.5 inches and the notch can have a height of about 0.15 inches. The belly section can comprise at least a belly section bend between the head and the tail.

In general, another innovative aspect of the subject matter described in this specification includes a method of manufacturing one or more rail anchors for a railroad track structure, comprising the steps of: for each of the one or more rail anchors, feeding a bar into a press, wherein the bar is oriented so that a height of a cross section of the bar is greater than a width of the cross section of the bar; forging each end of the bar to form, at each end, a shorter and wider profile, wherein a middle section of the bar is left having an original profile; forming a rail anchor shape; forming a jaw and a tail on the rail anchor; and forming a notch near the tail. The steps further comprise: quenching the one or more rail anchors; cooling the one or more rail anchors; and tempering the cooled rail anchors; wherein each rail anchor has a contact-bearing surface of at least 3.0 square inches and is adapted to extend at least 1.5 inches downward from the top of a railroad track crosstie along a side of the railroad track crosstie.

These and other implementations can each optionally include one or more of the following features. The method can further comprise the steps of: inspecting the rail anchors; testing the rail anchors; and packaging the rail anchors. The quench tank can comprise oil. The head, the tail, and the belly sections can be formed at a temperature in a range of about 1900 degrees Fahrenheit to 2300 degrees Fahrenheit, and the cooled rail anchor can be tempered at a temperature in a range of about 700 degrees Fahrenheit to 1000 degrees Fahrenheit. The head, the tail, and the belly sections can be formed at a temperature of about 2100 degrees Fahrenheit, and tempering the cooled rail anchors occurs at a temperature of about 800 degrees Fahrenheit for at least one hour.

In general, another innovative aspect of the subject matter described in this specification includes a method of installing a rail anchor on a railroad track structure, comprising the steps of: anchoring a rail with a rail anchor comprising a contact-bearing surface area adapted to contact a railroad track crosstie; wherein the rail anchor comprises a head, a tail, and a belly section; wherein the belly section comprises a top portion, a bottom portion, and two side surfaces; wherein each of the side surfaces comprises the contact-bearing surface area; wherein the contact-bearing surface area has a surface area of at least 3 square inches; and wherein the increased bearing surface area is adapted to extend at least 1.5 inches downward from the top of the railroad track crosstie along a side of the railroad track crosstie in the railroad track structure.

These and other implementations can each optionally include one or more of the following features. The contact-bearing surface area can have a surface area of about 5.5 square inches.

Particular implementations may realize none, or one or more of the following advantages. For example, the increased bearing area can disperse the load on the crosstie and lessen the damage to wood fibers. For example, this can be particularly important when soft wood crossties are encountered (e.g., in Canada).

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DESCRIPTION

Figures 1, 1A, 1B:
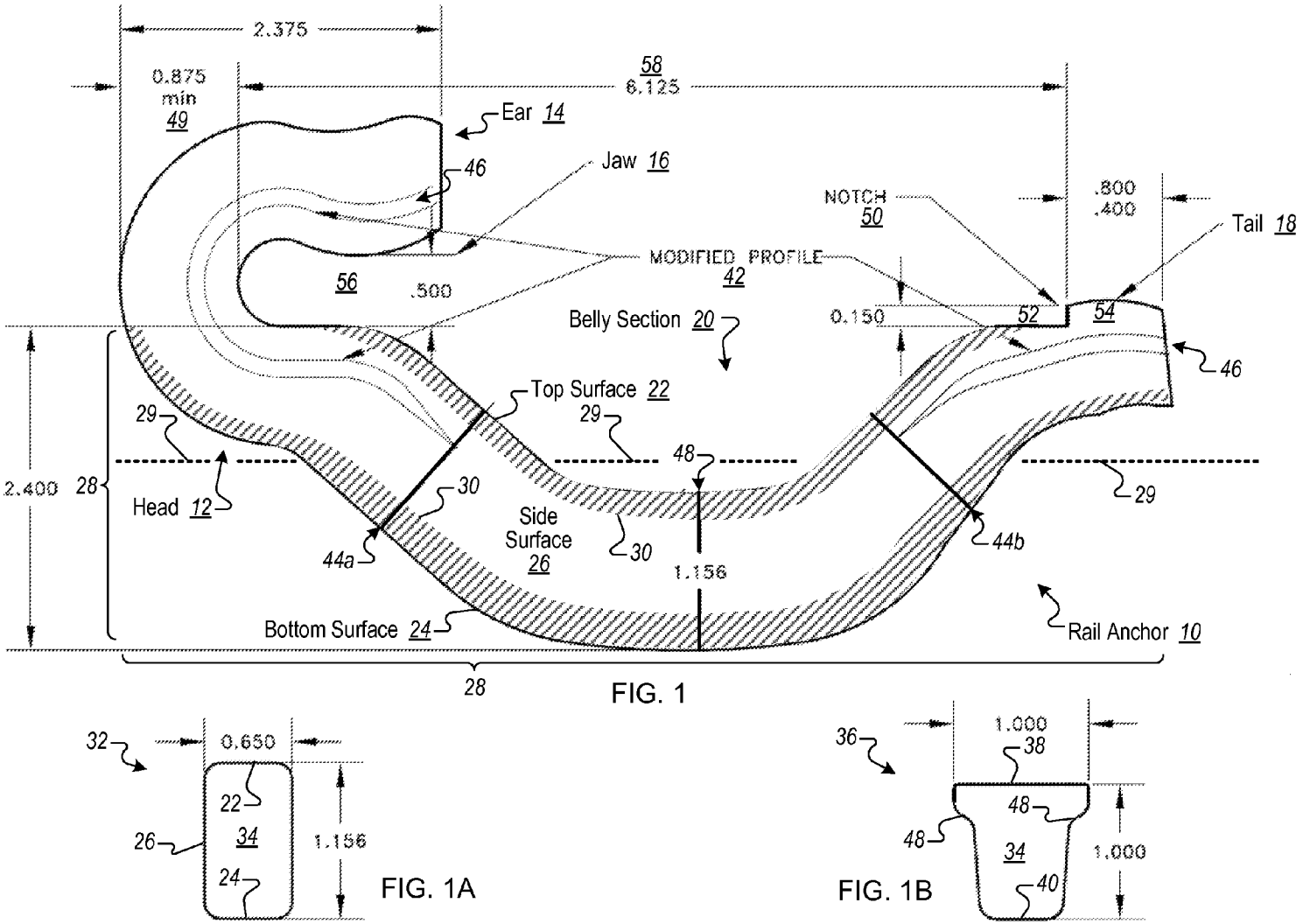
FIGS. 1, 1A and 1B show different views of an example rail anchor.

FIG. 1 shows an example rail anchor 10 in accordance with this disclosure. The rail anchor 10 includes a head 12 (comprising an ear 14 and a jaw 16), a tail 18, and a belly section 20. The belly section 20 includes a top surface 22, a bottom surface 24, and two side surfaces 26. The side surfaces 26 are on opposite sides of the rail anchor 10 (e.g., only one side surface 26 is shown in FIG. 1). Each side surface 26 includes a contact-bearing surface area 28 for contacting the side of a railroad track crosstie. In some implementations, each contact-bearing surface area 28 includes an increased surface area 30, depicted in FIG. 1 as shaded portions of the contact-bearing surface area 28. The un-shaded portion of the contact-bearing surface area 28 corresponds to existing rail anchors having smaller contact-bearing surface areas, or alternatively to existing rail anchors having increased contact-bearing surface areas wherein the increased contact-bearing surface area is adapted to engage with an upper portion of a crosstie. As shown in FIG. 1, the contact-bearing surface area 28, having its increased surface area 30, is adapted to engage with and stabilize lower or deeper portions of a crosstie as compared with existing rail anchors. In other words, as shown in FIG. 1, a substantial portion of the advantageously increased contact-bearing surface area 28 is below a plane 29 that is perpendicular to the view depicted in FIG. 1.

As an example, the rail anchor 10 in accordance with this disclosure may have a contact-bearing surface area 28 of about 5.6 square inches, whereas a typical rail anchor in current use may have a contact-bearing surface area of approximately 2.9 square inches. In this example, the improved rail anchor 10 of this disclosure has a contact-bearing surface area 28 more than 93% larger than existing rail anchors. As shown in FIG. 1, a significant portion of the increased surface area 30, compared with existing rail anchors in current use, is located on the bottom or lower portion of the rail anchor 10, such that the contact-bearing surface area 28 can contact and engage with lower or deeper portions of a crosstie. In this embodiment, the improved rail anchor 10 of this disclosure can provide improved bearing and support, including as the crosstie deteriorates over time.

FIG. 1A shows an example cross section 32 of a steel member 34 (e.g., a steel bar or rod) that may be used as the starting material for the manufacture of the rail anchor 10. For example, the steel member 34 can start as a substantially straight piece of steel before the shape of the rail anchor 10 is formed during the manufacturing process. The shape of the cross section 32 is present throughout substantially most of the belly section 20, as indicated by the top surface 22, the bottom surface 24, and the side surface 26 shown in FIGS. 1 and 1A. In some implementations, the contact-bearing surface area 28 can be at least 3.0 square inches and can be adapted to extend at least 1.5 inches downward from the top of a railroad track crosstie along a side of the railroad track crosstie. In some implementations, the contact-bearing surface area 28 can be about 5.5 square inches. This improved design increases the contact-bearing surface area 28 in the lower part of the rail anchor 10, which is advantageous for longer and better support and life of the anchored track structure, without requiring an increase in rail anchor weight. For example, the design of the rail anchor 10 avoids the requirement for additional weight that would be needed in order to increase the contact-bearing surface area 28. The design further avoids any resulting undesirable increase in the materials cost of the finished rail anchor 10, as well as significant changes to installation equipment.

FIG. 1B shows an example reshaped cross section 36 that can be used for the head 12 and the tail 18 of the rail anchor 10. In some implementations, the reshaped cross section 36 can include a widened contacting surface 38 that can be formed from the steel member 34 that originally has the substantially rectangular shape of the cross section 32. By comparison, the bell shape of the reshaped cross section 36 includes the widened contacting surface 38 and an un-widened non-contacting surface 40 that can be substantially similar to the bottom surface 24. In some implementations, the widened contacting surface 38 in the head 12 and the tail 18 can provide an increased contacting area where the rail anchor 10 contacts the railroad rail (not shown) after installation of the rail anchor 10. The widened contacting surface 38 can be formed into the rail anchor 10 without increasing the overall weight or the amount of material used in manufacturing. This is because the reshaped cross section 36 represents a reshaping of the steel member 34. In some implementations, as shown by the cross section 32, the steel member 34 has a width of about 0.65 inches and a height of about 1.156 inches. Other implementations have different dimensions of the steel member 34. In some implementations, as shown by the reshaped cross section 36, the steel member 34, after it has been reshaped during the manufacturing process, has a width of about 1.0 inches and a height of about 1.0 inches. Other implementations have different dimensions of the reshaped cross section 36.

Using a longer axis of the bar stock and inducing a bell-shaped cross section in the head 12 and jaw 16 can resist yielding, i.e., jaw gap widening, thereby maintaining designed holding force to the rail and lessening rail anchor slippage. These characteristics can also lead to better performance during reapplication of rail anchors.

In some implementations, the height of the contact-bearing surface area 28 that hangs below the plane 29 representing the top of a crosstie and where the rail anchor 10 contacts the side of the crosstie can be about 2.4 inches. In some implementations, the portions of the rail anchor 10 that can have a cross-sectional shape that matches the reshaped cross-section 36 can include the head 12 and the tail 18, providing a modified profile 42 on the rail anchor 10. For example, the modified profile 42 can extend from the end of the ear 14 to a transition point 44*a*, at which point the cross-sectional shape of the rail anchor 10 matches the shape of the cross section 32. Similarly, a transition point 44*b* can mark the point along the rail anchor 10 at which ends the cross-sectional shape of the belly section 20 having a shape matching the cross section 32. At the a transition point 44*b*, the cross-sectional shape of the rail anchor 10 transitions toward having a shape matching the reshaped cross section 36 present in most of the tail 18. Contour lines 46 in the modified profile 42 correspond to major curves 48 in the reshaped cross section 36.

In some implementations, a middle portion of the belly section 20 can have a height 48 of about 1.156 inches, e.g., matching the height of the cross section 32 of the steel member 34. In some implementations, a top-to-bottom thickness 49 of a substantial portion of the head 12 can be at least about 0.875 inches, e.g., the resulting thickness of the head 12 after being bent to form the jaw 16 during the manufacturing process. In some implementations, a notch 50 formed in the tail 18 can have a height 52 of about 0.15 inches. In some implementations, a portion 54 of the tail 18 that is beyond the notch 50 can have a length of between about 0.4 to 0.8 inches. In some implementations, the jaw 16 can have an opening 56 of about 0.5 inches, e.g., slightly less than the thickness of the base of a standard rail, e.g., allowing the jaw 16 to deflect when installed and to produce a clamping force that holds the jaw 16 in place on the rail. In some implementations, a distance 58 between the most distant ends of the jaw 16 and the notch 50 can be about 6.125 inches, e.g., matching the width of the base of a standard rail. For example, the opening 56 in the jaw 16 can be sized to allow for easy and efficient installation of the rail anchor 10 onto the base of a standard rail. In some implementations, for rail anchors 10 manufactured for rails of other sizes (e.g., a 5½ inch rail), the distance 58 between the most distant ends of the jaw 16 and the notch 50 can be different (e.g., about 5⅝ inches).

Figure 2:
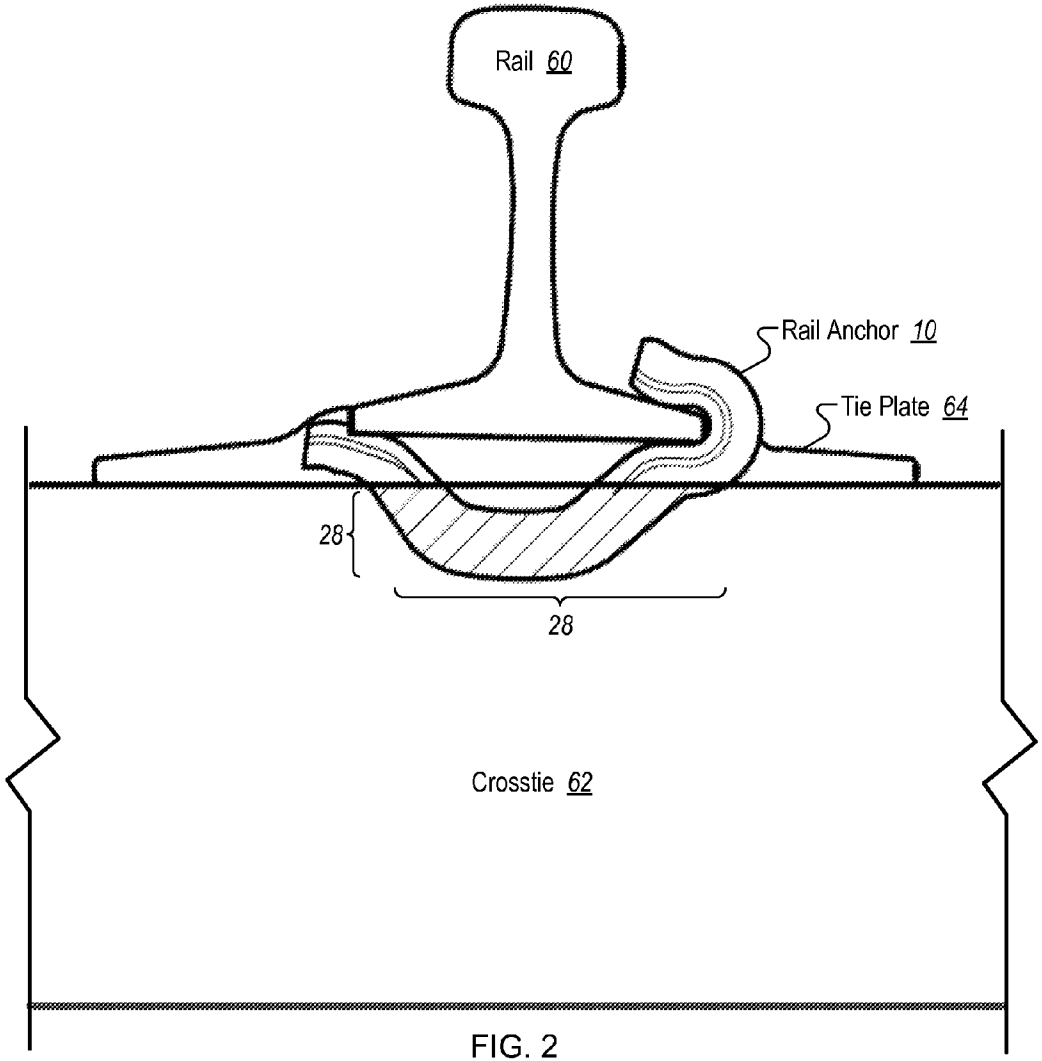
FIG. 2 shows an example longitudinal cross section of an installed version of the rail anchor.

FIG. 2 shows an example longitudinal cross section of an installed version of the rail anchor 10 in accordance with this disclosure. The installed rail anchor 10 connects a rail 60 to a crosstie 62. The contact-bearing surface area 28 of the rail anchor 10 can fit against the edge of a crosstie 62 and can serve to support the rail 60 against the crosstie 62. In some implementations, another rail anchor 10 can be installed on the other side of the crosstie 62. The rail 60 rests on top of a tie plate 64. As shown in FIG. 2, no connection exists between the rail anchor 10 and the tie plate 64.

Figure 3B:
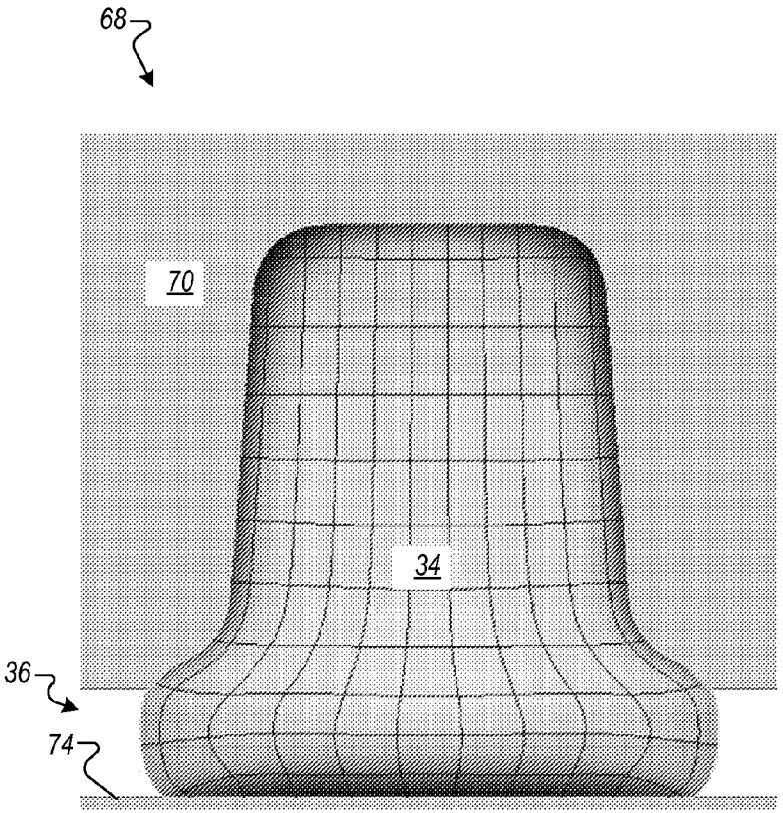
FIGS. 3A and 3B show steps of an example process for forming the head and the tail.
Figure 3A:
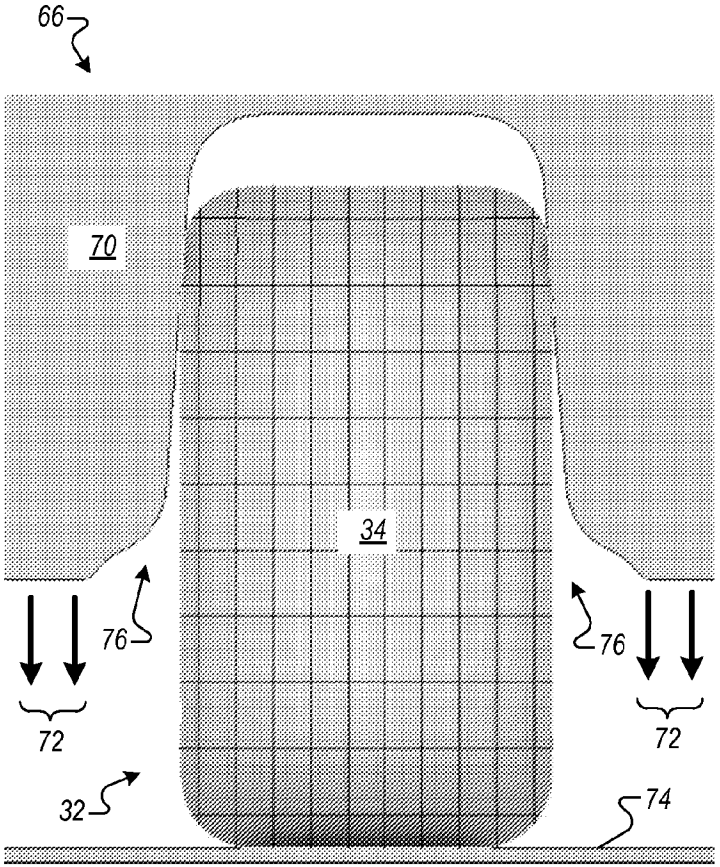

FIGS. 3A and 3B show simulation steps 66 and 68, respectively, of an example process for forming the bell shape of the reshaped cross section 36 onto the head 12 and the tail 18. In some implementations, the reshaped cross section 36 can be formed when a die 70, in motion downward, contacts the steel member 34 and presses the steel member 34 downward, as shown by directional arrows 72. At this step 66 in the simulation, the steel member 34 has a cross-sectional shape matching the cross section 32. In this example, the steel member 34 is hot (e.g., about 2100 degrees Fahrenheit), allowing the steel member 34 to be shaped. As a result, the steel member 34 can be pressed downward, and the bottom edge of the steel member 34 can be substantially flattened against a hard surface 74, as shown in FIG. 3B. In this way, the bell shape of the reshaped cross section 36 can be formed. In some implementations, the die 70 can have substantially a bell-shaped opening, or a portion thereof, approximately slightly wider than the width of the steel member 34.

Figure 4:
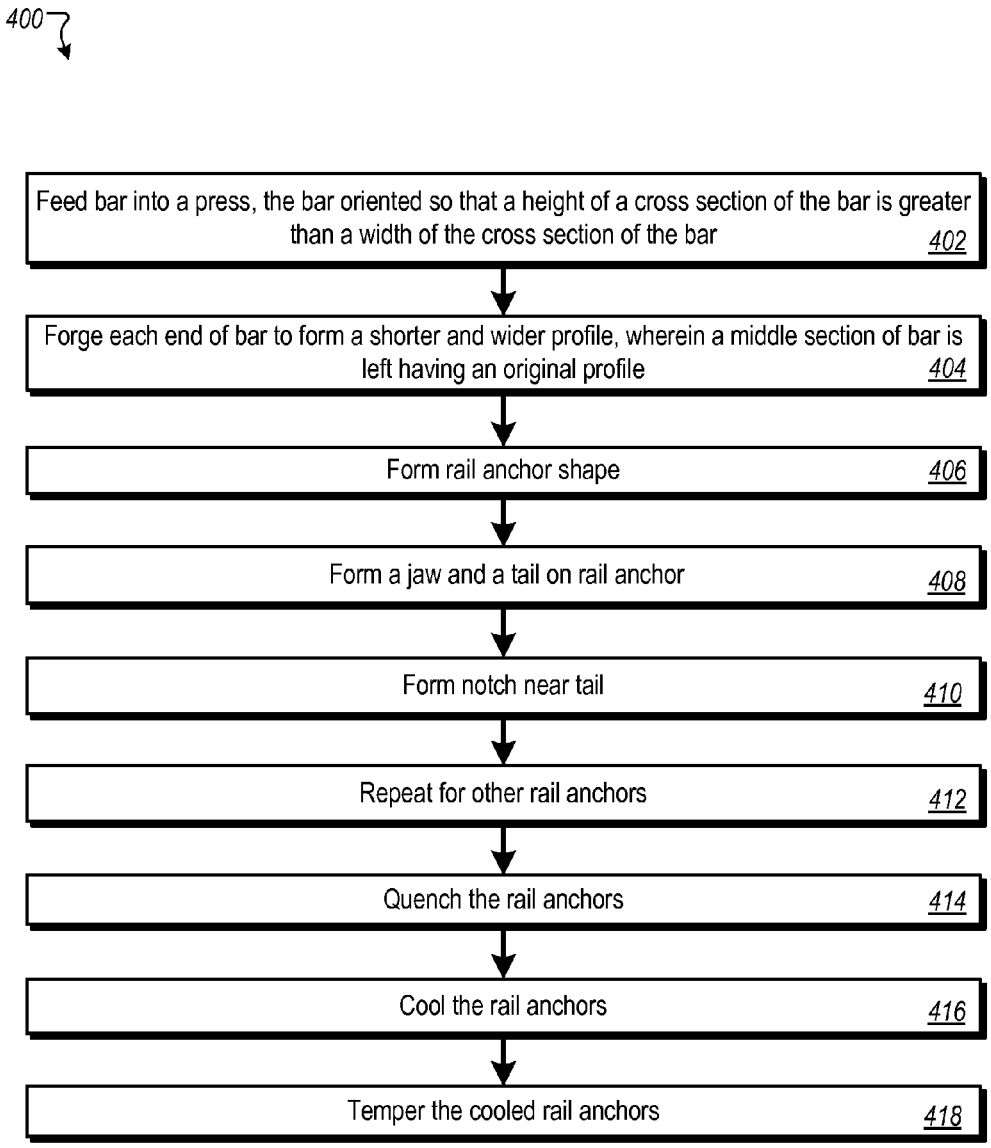
FIG. 4 shows an example process for manufacturing rail anchors.

FIG. 4 shows an example process 400 for manufacturing rail anchors 10 of this disclosure. A bar is fed into a press (402). The bar is oriented so that a height of a cross section of the bar is greater than a width of the cross section of the bar. For example, the steel member 34 can be fed into a press, such that the cross section of the steel member 34 is upright as shown in the cross section 32. In some implementations, the bar can be transferred to a first blow station. Each end of the bar is forged to form a shorter and wider profile, wherein a middle section of bar is left having an original profile (404). For example, during a process such as that described with reference to FIGS. 3A and 3B, the bell shape of the reshaped cross section 36 ends of the bar are formed in the ends of the steel member 34 that will become the head 12 and the tail 18.

In some implementations, the bar can be transferred to a second blow station. The rail anchor shape is formed (406). For example, bends in the rail anchor 10 at either end of the belly section 20 can be formed. In some implementations, the bar can be transferred to a third blow station. A jaw and a tail are formed on the rail anchor (408). For example, the jaw 16 and the tail 18 can be formed by a third blow, and as a result, the rail anchor 10 can achieve its general shape. A notch is formed near the tail (410). For example, referring to FIG. 2, the notch 50 can be formed in the tail 18. Steps in the process 400 can be repeated for other rail anchors (412). For example, other rail anchors 10 can be formed from steel members 34. In some implementations, one or more rail anchors 10 simultaneously can undergo the same manufacturing steps at any one blow station. For example, one or more of the manufacturing stations can work on rail anchors in parallel. In some implementations, the head, tail and belly sections can be formed when the rail anchor 10 is at a temperature in a range of about 1900 degrees Fahrenheit to 2300 degrees Fahrenheit (e.g., about 2100 degrees Fahrenheit).

In some implementations, the rail anchors 10 can be transferred to a quenching station. In some implementations, the quenching station can include one or more quench tanks, each of which can contain oil, an oil mixture, or some other mixture. In some implementations, as each rail anchor 10 is formed into its final shape, it can be transferred to a quenching station. In some implementations, shaped rail anchors 10 can be transferred to the quenching station. One or more rail anchors are quenched (414). In some implementations, the rail anchors 10 can be removed from the quench tank for cooling. The rail anchors are cooled (416). The cooled rail anchors are tempered (418). In some implementations, rail anchors 10 can be tempered at a temperature in a range of about 700 degrees Fahrenheit to 1000 degrees Fahrenheit. In some implementations, rail anchors can be tempered at a temperature of about 800 degrees Fahrenheit for at least one hour. In some implementations, the rail anchors 10 can be inspected, tested and packaged. In some implementations, the rail anchors 10 can be inspected for dimensional accuracy. In some implementations, the rail anchors 10 can be tested for hardness (e.g., heat treat results), resistance to slipping on a rail, and resistance to impact (e.g., impacts applied to the jaw 16).

To use the rail anchor 10 of this disclosure, the rail anchor 10 may be installed in a railroad track structure manually or by machine. Because of the advantageous structure in which the design provides for an increased bearing surface without increasing the weight of the finished rail anchor, the rail anchor 10 of this disclosure may be adapted to existing installation methods and equipment.

Other embodiments of the rail anchor of this disclosure are within the scope of the appended claims.

What is claimed is:

1. A rail anchor, comprising:

a head, a tail, and a belly section;

wherein said belly section comprises:

a top surface, a bottom surface, and two side surfaces;

wherein each said side surface comprises a contact-bearing surface area;

wherein said head comprises a bend along a length of said head, said bend comprising a jaw opening;

wherein said tail comprises a notch;

wherein said head comprises a widened top surface along a length of said head, said widened top surface widened with respect to a width of said top surface of said belly section, said widened top surface comprising widened opposed upper and lower surfaces of said jaw opening;

wherein each said contact-bearing surface area has a surface area of at least 3 square inches and is adapted to extend at least 1.5 inches downward from the top of a railroad track crosstie along a side of the railroad track crosstie.

2. The rail anchor of claim 1 wherein said contact-bearing surface area has a surface area of about 5.5 square inches.

3. The rail anchor of claim 1 wherein:

said tail also comprises a widened top surface along a length of said tail.

4. The rail anchor of claim 3, wherein said widened top surface along the length of said head and said widened top surface along the length of said tail are formed from a same substantially rectangular cross section of material that forms said belly section.

5. The rail anchor of claim 4, wherein said rectangular cross section of material has a vertical dimension of about between 1.0 inches to 1.3 inches and a horizontal dimension of about between 0.5 inches to 0.75 inches.

6. The rail anchor of claim 5, wherein said rectangular cross section of material has a vertical dimension of about 1.156 inches and a horizontal dimension of about 0.65 inches.

7. The rail anchor of claim 1, wherein said belly section has a substantially rectangular cross section along a length of said belly section.

8. The rail anchor of claim 1 wherein each of said side surfaces of said belly section includes a vertical dimension that exceeds a horizontal dimension of said top surface of said belly section.

9. The rail anchor of claim 1 wherein said contact-bearing surface area of each of said side surfaces is adapted to contact said side of said railroad track crosstie.

10. The rail anchor of claim 1 wherein the rail anchor, comprising said bend along said length of said head and said notch in said tail, is adapted to engage opposite sides of a railroad track rail.

11. The rail anchor of claim 10, wherein a jaw opening in said bend along said length of said head has a dimension of about 0.5 inches and said notch has a height of about 0.15 inches.

12. The rail anchor of claim 1, wherein said belly section comprises at least a belly section bend between said head and said tail.

* * * * *